US007421867B2

(12) United States Patent
Bongini

(10) Patent No.: US 7,421,867 B2
(45) Date of Patent: Sep. 9, 2008

(54) LAUNDRY WASHING MACHINE, IN PARTICULAR A FRONT LOADING WASHING MACHINE, WITH A DISPENSER OF WASHING AGENTS

(75) Inventor: Dino Bongini, Bergamo (IT)

(73) Assignee: Merloni Elettrodomestici S.p.A., Fabriano (Ancona) (IT)

( * ) Notice: Subject to any disclaimer, the term of this patent is extended or adjusted under 35 U.S.C. 154(b) by 611 days.

(21) Appl. No.: 10/769,750

(22) Filed: Feb. 3, 2004

(65) Prior Publication Data

US 2004/0216499 A1 Nov. 4, 2004

(30) Foreign Application Priority Data

Apr. 2, 2003 (IT) ..... TO2003A0066

(51) Int. Cl.
*D06F 39/02* (2006.01)

(52) U.S. Cl. ..... 68/17 R; 68/207; 134/93

(58) Field of Classification Search ..... 134/93, 134/56 D, 58 D; 68/17 R, 207
See application file for complete search history.

(56) References Cited

U.S. PATENT DOCUMENTS 2,174,729 A * 10/1939 Schlack ..... 222/57
2,339,396 A * 1/1944 Harvey ..... 422/261
2,410,873 A * 11/1946 Gayring ..... 222/652
2,699,886 A * 1/1955 James, Jr. ..... 222/154
2,861,581 A * 11/1958 Ryckman, Jr. ..... 134/58 R
2,899,815 A * 8/1959 Hetrick ..... 68/17 R
2,927,600 A * 3/1960 Pellerin ..... 137/266
2,967,416 A * 1/1961 Devery ..... 68/17 A
2,969,072 A * 1/1961 Barritt ..... 134/93
2,990,707 A * 7/1961 Gerhardt et al. ..... 68/12.18
3,022,656 A * 2/1962 Bergeson et al. ..... 68/207
3,100,978 A * 8/1963 Howlett ..... 68/140
3,159,016 A * 12/1964 Hertig et al. ..... 68/17 R (Continued)

FOREIGN PATENT DOCUMENTS

DE 1902679 8/1970

(Continued)

OTHER PUBLICATIONS

European Patent Office 430 366 Jun. 1991.*

*Primary Examiner*—Frankie L Stinson
(74) *Attorney, Agent, or Firm*—Sughrue Mion, PLLC

(57) ABSTRACT

A laundry washing machine comprises a dispenser of washing agents (10) having at least a movable body (26A, 26B, 40) defining a compartment for containing a dose of a respective washing agent. The movable body (26A, 26B, 40) is mounted in a housing (11) in such a way as to be able to assume a first position, for the manual admission of a washing agent into the compartment through a loading mouth (27, 41), and a second position, for withdrawing the washing agent from the compartment by means of a flow of liquid (IN). The movable body (26A, 26B, 40) is pivotally supported in the respective housing (11) to move angularly from said first to said second position and vice versa, around an axis (X) that is substantially perpendicular or otherwise transverse relative to the axis (Y) of the loading mouth (27, 41) of the body (10). Preferably, the movement of the body (26A, 26B, 40) from the first to the second position is obtained by means of the aforesaid flow of liquid (IN).

19 Claims, 9 Drawing Sheets

U.S. PATENT DOCUMENTS 3,160,319 A * 12/1964 Lengsfeld et al. ..... 222/54
3,220,607 A * 11/1965 Seal ..... 222/54
3,333,739 A * 8/1967 Clearman et al. ..... 222/166
3,406,695 A * 10/1968 Perl ..... 134/58 D
3,612,074 A * 10/1971 Dossey ..... 134/93
3,670,530 A * 6/1972 Filipak ..... 68/17 A
3,915,349 A * 10/1975 Losert et al. ..... 222/166
4,265,100 A * 5/1981 Kretchman et al. ..... 68/12.18
4,323,170 A * 4/1982 Ikeda ..... 222/652
5,548,978 A * 8/1996 Bongini et al. ..... 68/17 R
5,875,655 A * 3/1999 Herman-Latack et al. ... 68/17 R
5,934,109 A 8/1999 Kiefer et al.

FOREIGN PATENT DOCUMENTS

DE 9402286.0 12/1994
EP 0655523 A1 5/1995
JP 2002143597 11/2000

* cited by examiner

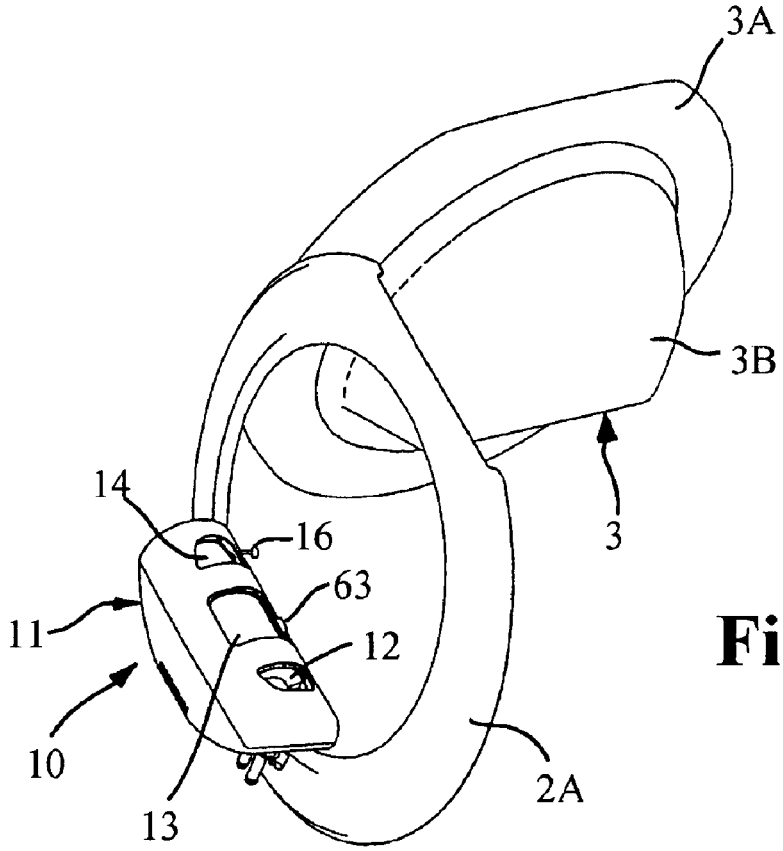
Fig. 2
Fig. 3
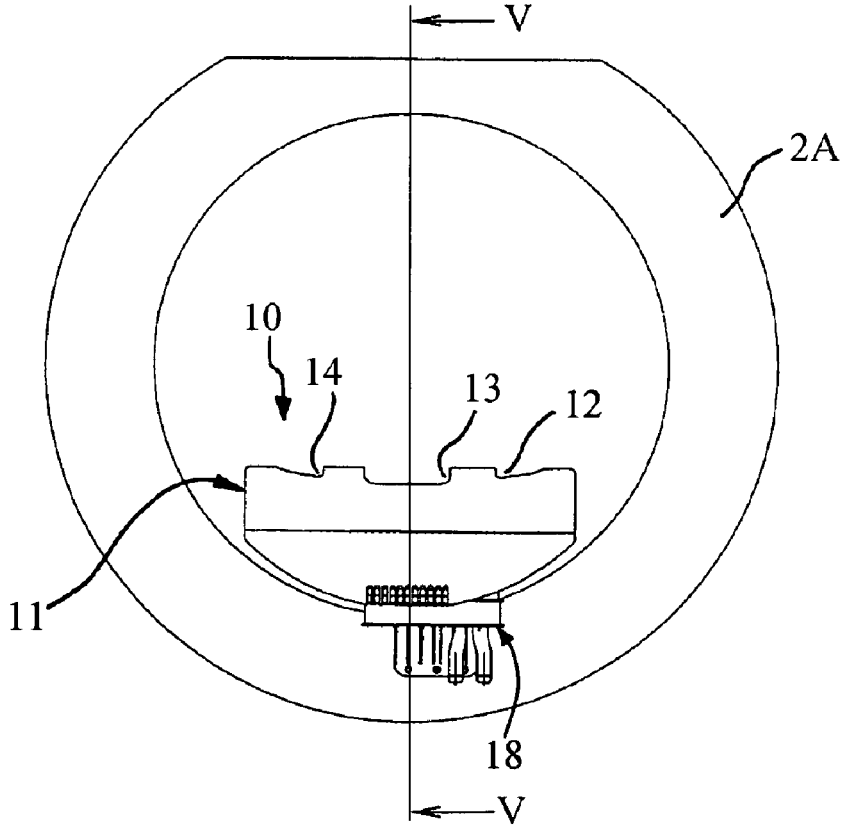

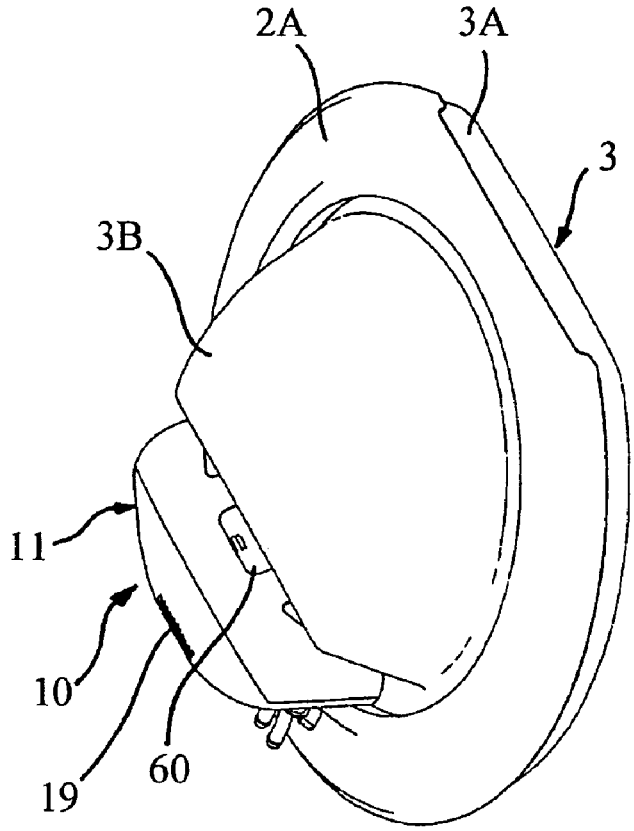
Fig. 10
Fig. 11
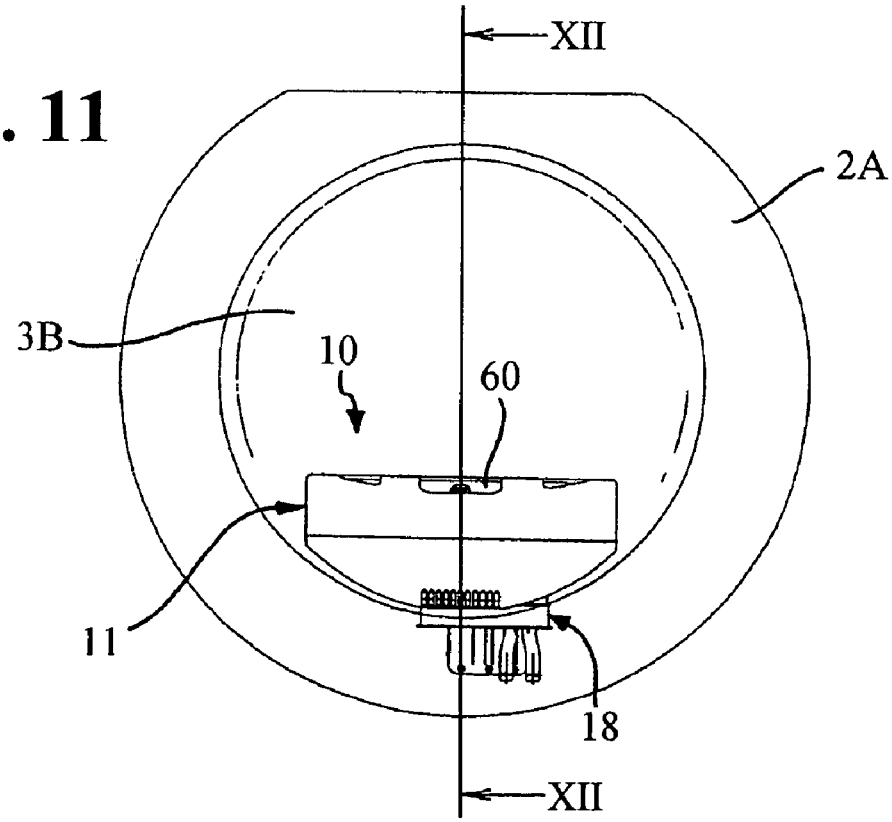

LAUNDRY WASHING MACHINE, IN PARTICULAR A FRONT LOADING WASHING MACHINE, WITH A DISPENSER OF WASHING AGENTS

FIELD OF THE INVENTION

The present invention relates to a laundry washing machine, in particular a front loading washing machine, and to a dispenser of washing agents for a washing machine.

DESCRIPTION OF THE BACKGROUND ART

In the case of laundry washing machines, the washing agent dispenser usually comprises a drawer subdivided into a series of compartments, each of which is destined to be loaded with a dose of detergent and/or additive to be used in a respective phase of the washing program or cycle. The aforesaid drawer is slidably housed in a housing space, defined in the upper part of the machine cabinet and having a hopper-like bottom, a tube connecting the hopper-like bottom with the washing tub.

The drawer is movable between a first position, for loading the desired washer agent or agents, and a second position, for withdrawing the washing agents by means of a flow of water; in the two positions, the drawer is for the most part respectively extracted from or inserted into the respective housing space, the shift from the first to the second position, and vice versa, being conducted manually.

In the withdrawal or working position, each of the compartments of the drawer can be traversed by a flow of water which drives the washing agents into the tub, by means of the aforesaid hopper-like bottom and the respective tube connecting to the tub. Depending on the type of load of the laundry to be washed, the user therefore selects a washing program and places into the various compartment of the drawer the recommended quantities of the required washing agents; at the appropriate time, upon command from the control system (which can be electromechanical or electronic) of the machine, the water to be loaded into the washing tub of the machine is made to transit selectively through each of the various compartments, to drive into the tub the related washing agent; in other words, then, based on the selected program, and depending on the washing phases reached, the control system causes the different washing agents to be withdrawn from the related compartments at the appropriate times.

SUMMARY OF THE INVENTION

The object of the present invention is to obtain a dispenser of washing agents of new conception for a washing machine, that is simple and convenient to use, has precise and reliable operation, is easy to construct and has low cost.

These and other objects are achieved, according to the present invention, by a laundry washing machine, in particular with front loading, and by a dispenser of washing agents having the characteristics of the appended claims, which are understood to be an integral part of the present description.

BRIEF DESCRIPTION OF THE DRAWINGS

Additional objects, characteristics and advantages of the present invention shall become readily apparent from the detailed description that follows and from the accompanying drawings, provided purely by way of explanatory and non limiting example, in which:

FIGS. 2 and 3 are respectively a perspective and an elevation view of some parts of the machine in FIG. 1 in a first operative condition, the views being from the internal side of the machine;

FIGS. 10 and 11 are views similar to those of FIGS. 2 and 3 of some parts of the machine of FIG. 1 in a second operative condition;

DESCRIPTION OF A PREFERRED EMBODIMENT

Figure 4:
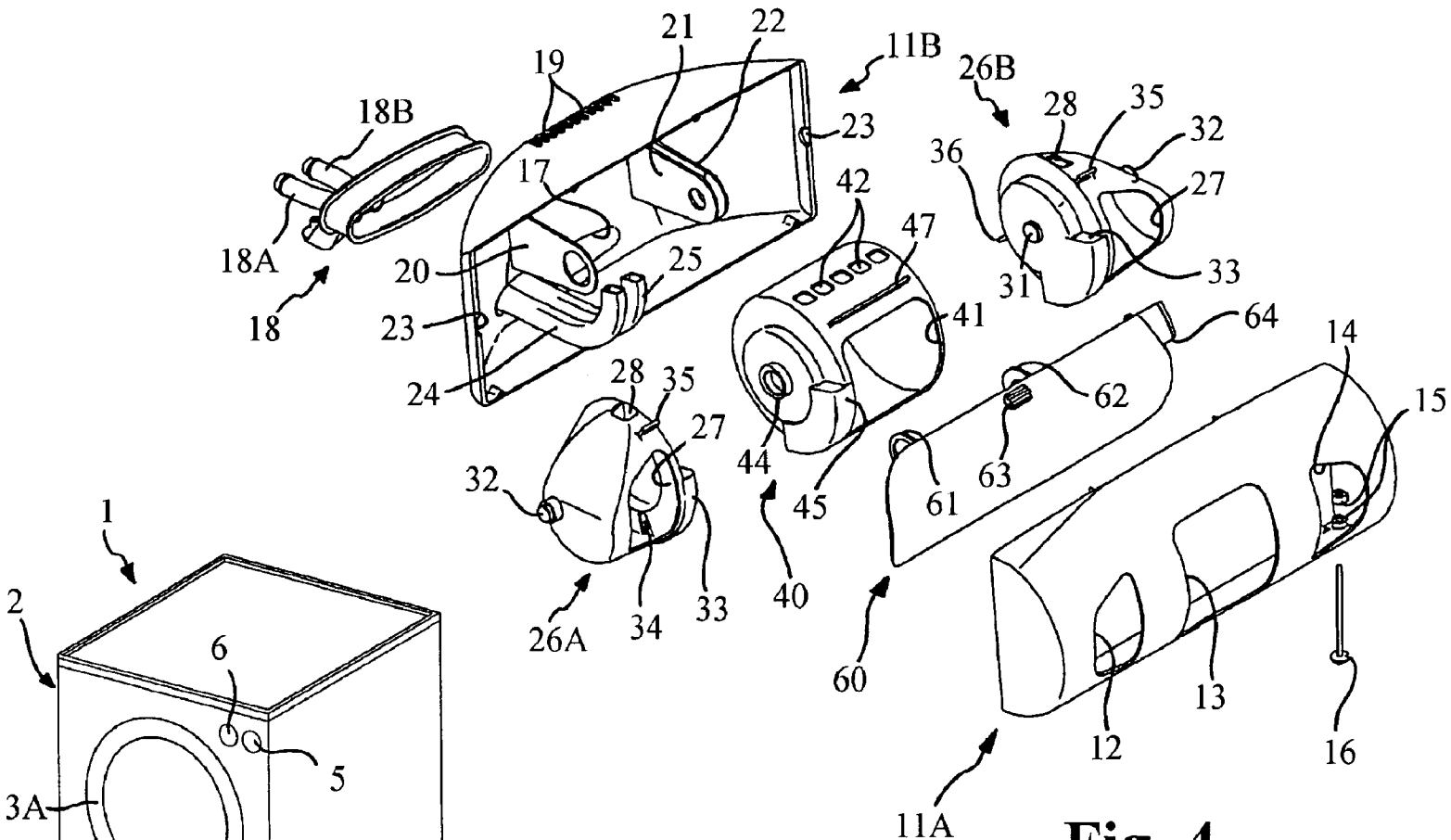
FIG. 4 is an exploded schematic view of the dispenser of the invention.
Figure 1:
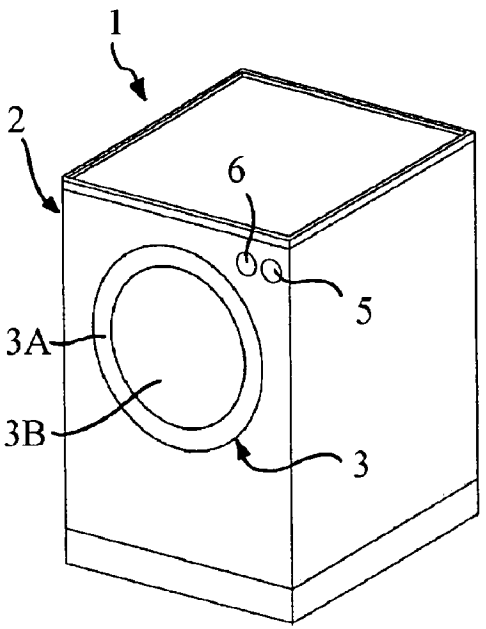
FIG. 1 is a schematic perspective view of a front lauded laundry washing machine according to the invention.
Figure 6:
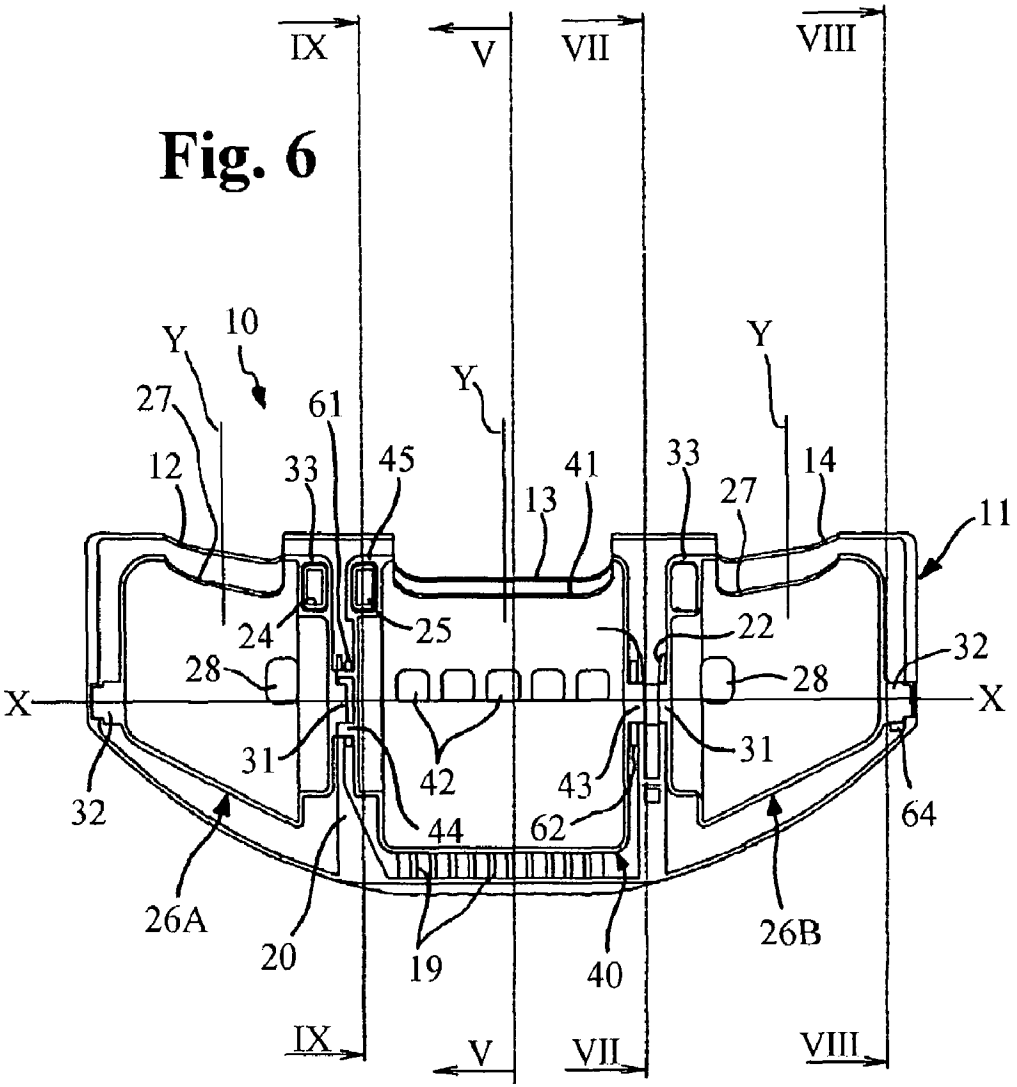
FIG. 6 is a schematic section according to the line VI-VI of FIG. 5.

In FIG. 1, the reference number 1 globally designated a laundry washing machine provided with a device for dispensing washing agents according to the invention. The reference number 2 designates the metal plate cabinet of the laundry washing machine 1, having substantially parallelepiped shape, within which a washing tub is mounted, which houses a drum pivotally mounted according to a substantially horizontal or inclined axis. The cabinet 2 has a front opening, in correspondence with which the loading door of the machine is positioned, globally designated by the reference number 3. The door 3 comprises a respective frame 3A and a transparent central part 3B, for example made of glass, contoured towards the interior of the cabinet 2; in the exemplified case, the frame 3A and the transparent part 3B are substantially circular, but their shape could naturally be different; for example, the frame 3A could be quadrangular and the part 3B could have rounded shape, but flattened at the top or at the bottom. The door 3 is also provided with means for hinging to the cabinet 2 and with a safety locking device, which elements are not shown as they are known in themselves.

The opening of the cabinet 2 in which the door 3 is operative faces a homologous opening present in the front wall of the washing tub of the machine 1; as in the prior art, the front opening of the tub in turn faces a corresponding opening defined in the front part of the drum in the machine 1; in this way, with the door 3 open, the laundry can be loaded into the drum or be unloaded therefrom. Between the front part of the cabinet 2 and the opening of the tub are provided suitable sealing means, such as a gasket with substantially annular and/or tapered shape, which ends in correspondence with the opening of the drum.

Also in FIG. 1, the references 4 and 5 respectively designate a knob for selecting a washing cycle of the machine and a knob for selecting the desired temperature for the washing liquid; other control and display devices, such as push-buttons, switches, indicator lights, displays, etcetera, not shown in the figures for the sake of simplicity.

In the embodiment exemplified in the figures, the dispenser of washing agents of the invention is mounted in correspondence with the lower edge of the front opening of the cabinet 2, in such a way as to project towards the interior of the cabinet itself, and in particular in the space delimited by the aforesaid gasket. An arrangement substantially of this kind is described for example in EP-A-655 523.

FIGS. 2 and 3 show, for this purpose, only the dispenser according to the invention, globally designated by the reference number 10, the door 3 in the open condition and only a limited annular portion 2A of the front wall of the cabinet 2, in correspondence with which the door 3 and the dispenser 10 are mounted.

With reference also to FIGS. 4 through 9, the dispenser 10 has a body 11 formed by an upper half-shell 11A and a lower half-shell 11B. The upper half-shell 11A, substantially semi-cylindrical, has three through openings 12, 13 and 14; on a lateral wall of the half-shell 11A, towards the interior thereof, guides 15 are formed for a control rod 16, whose function shall be clarified below. The lower half-shell 11B, substantially hopper-like, has a bottom defining a coupling 17, shown also in FIG. 5, for mounting a liquid distributor 18; the latter has a plurality of respective union fittings, two whereof are designated by the numbers 18A and 18B, for the connection, by means of tubes not shown herein, to a source of liquid, in particular water coming from a water supply line whereto the machine 1 is connected in a known manner.

In the front wall of the half-shell 11B slits 19 are formed through which, as will be illustrated below, the water with a washing agent added thereto is loaded directly into the drum of the machine, exploiting the presence of the aforesaid gasket. From the bottom wall of the half-shell 11B three support brackets 20, 21 and 22 elevate centrally, each having a circular hole in the respective top area. On the upper edge of each of the two lateral walls of the half-shell 11B a respective semicircular recess 23 is defined; similar recesses, not shown herein, are defined on the lower edge of each of the two lateral walls of the upper half-shell 11A; in this way, following the coupling between the two half-shells 11A, 11B, the recesses 23 thereof form seats with circular section, which are substantially coaxial to the holes present in the brackets 20, 21 and 22.

From the coupling 17 of the bottom wall of the half-shell 11B two conduits 24 and 25 elevate, having substantially quadrangular section. Each of the conduits 24 and 25 has a respective substantially rectilinear segment or stretch and an arched terminal segment or stretch, developing for about 90°. Following the coupling of the distributor 18 on the respective coupling 17 (see for example FIG. 5), each of the union fittings 18A, 18B is in hydraulic communication with a respective conduit 24, 25. Note that, in actuality, at least from the side of the fitting 17 longitudinally opposite the one in which there are present the conduits 24, 25 an addition conduit of the same type starts, whose representation is omitted in the accompanying figures for the sake of greater clarity.

The references 26A and 26B designates a first and a second identical, which are identical, for a respective washing agent, in particular a bleach and a washing additive or softener. Each container 26A, 26B is shaped substantially as a cone frustum and has on the respective circumferential wall a loading opening 27 and an outflow slit 28, positioned at about 90° from each other. On the larger lateral wall of each container 26A, 26B there is defined a projecting area bearing a pivot with circular section, designated 31 in FIGS. 4 and 6, the pivot 31 of the container 26B being destined to be operatively inserted in the through hole of the bracket 22. On the other side, on the smaller lateral wall of the each container 26A, 26B there is defined a pivot 32 with circular section, able to be inserted in a respective seat formed by the union of the recesses 23 of the half-shells 11A, 11B, when they are mutually coupled (see for example FIG. 6).

On the wall of each container 26A, 26B provided with the pivot 31 a channel 33 is also formed, having slightly larger section dimension than the conduit 24 or 25. The channel 33 has an arched development, of about 90°, and is open at its lower end oriented towards the distributor 18 (see FIG. 9).

In the initial segment or stretch of the channel 33, in proximity with the inlet, an outlet port is provided, which places the channel in communication with the interior of the respective container 26A, 26B. The aforesaid port is designated 34 in FIG. 4, in relation to the channel 33 of the container 26A.

On the circumferential wall of each container 26A, 26B two projections 35, 36 are also provided; as will become readily apparent hereafter, the projection 35 is provided to constitute a stop to the angular movement of the respective container 26A, 26B, whilst the projection 36 is provided to achieve the manual actuation of the respective container 26A, 26B, by means of a door of the dispenser 10, described hereafter.

The reference number 40 designates a third container of a washing agent, in particular a washing detergent. The container 40 has substantially cylindrical shape and on its respective circumferential wall it has a loading opening 41 and a series of outflow slits 42, the former being positioned at about 90° from the latter. On a lateral wall of the container 40 a pivot 43 is defined, with circular section, shown in FIG. 6, able to be inserted into the through hole of the bracket 21; on the opposite wall of the container 40 a projecting area is defined, bearing a pivot 44 with circular section, able to be inserted into the through hole of the bracket 20; the pivot 44 centrally defines a blind seat, into which the pivot 31 of the container 27 is able to be inserted (see FIG. 6).

On the wall of the container 40 provided with the pivot 44 a channel 45 is also defined, whose section is similar to that of the channels 33 of the containers 26A, 26B. The channel 45 thus also has an arched development, of about 90°, an end inlet and an outlet port similar to the one previously designated as 34; said outlet port of the channel 45 is designated as 46 in FIG. 5.

Figure 9:
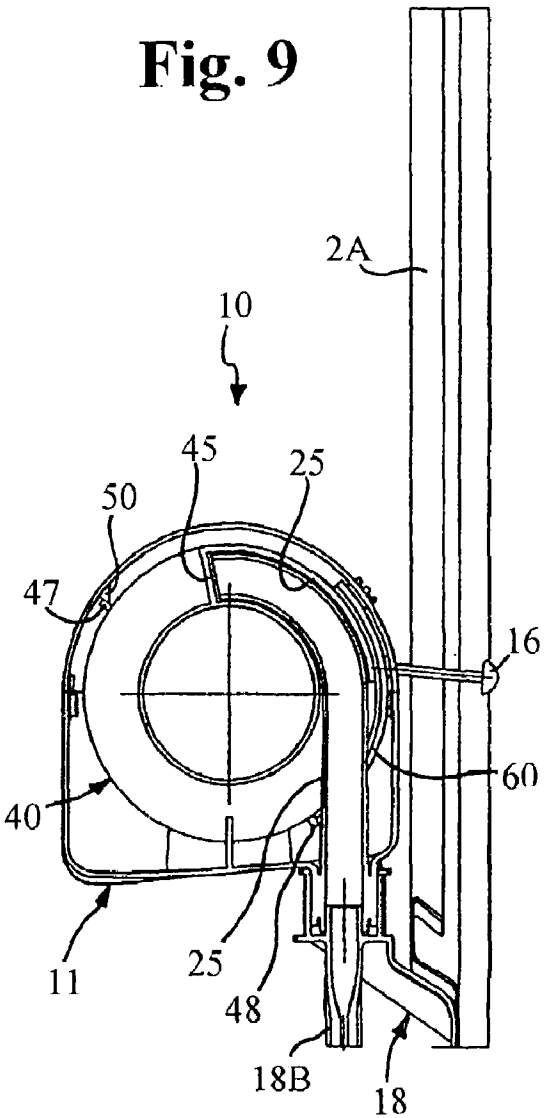
FIGS. 7, 8 and 9 are schematic sections respectively according to the lines VII-VII, VIII-VIII and IX-IX of FIG. 6.

On the circumferential wall of the container 40 a first projection 47 is provided, serving a similar function to that of the projections 35 of the containers 26A, 26B; the container 40 also has a second projection, designated 48 in FIG. 9, serving a similar function to that of the projection 36 of the containers 26A, 26B.

The reference number 60 globally designates an angularly movable door, having substantially semi-circular section, provided to occlude the openings 12, 13, 14 present in the half-shell 11A.

Figure 7:
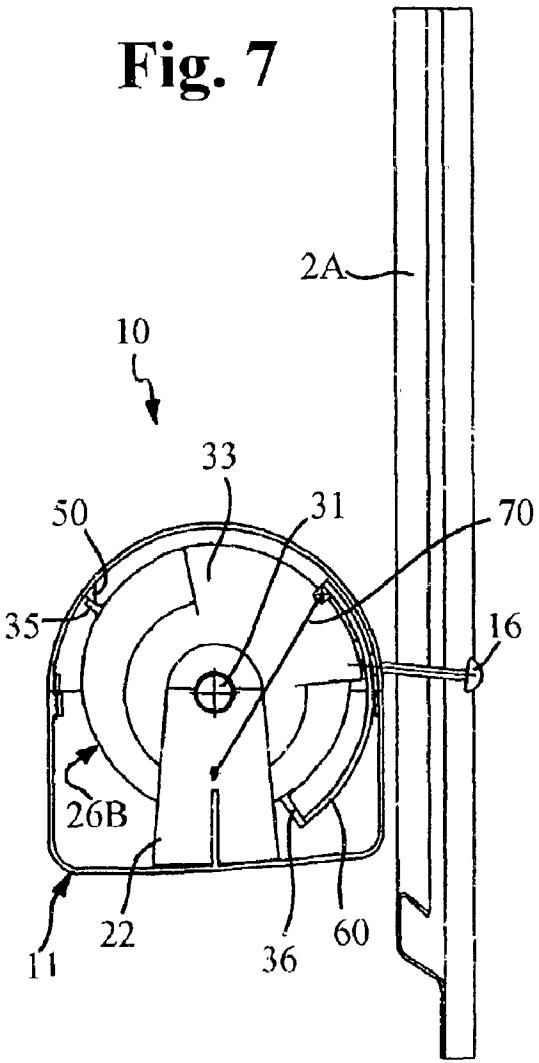
Figure 13:
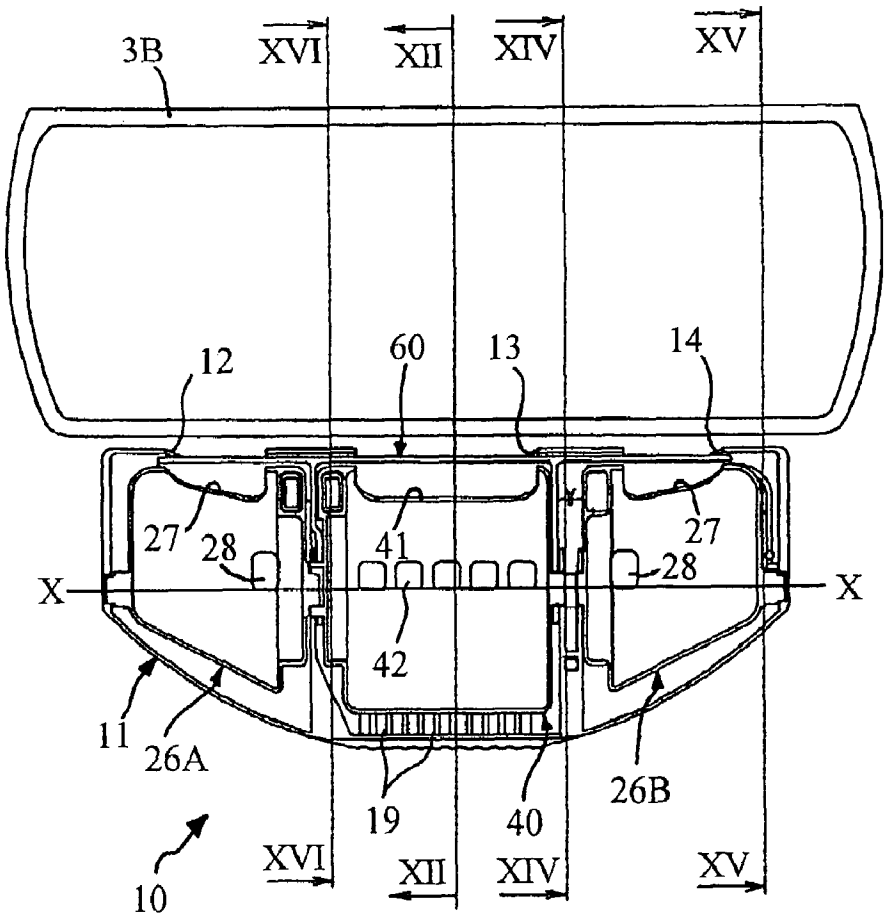
FIG. 13 is a schematic section according to the line XIII-XIII of FIG. 12.
Figure 12:
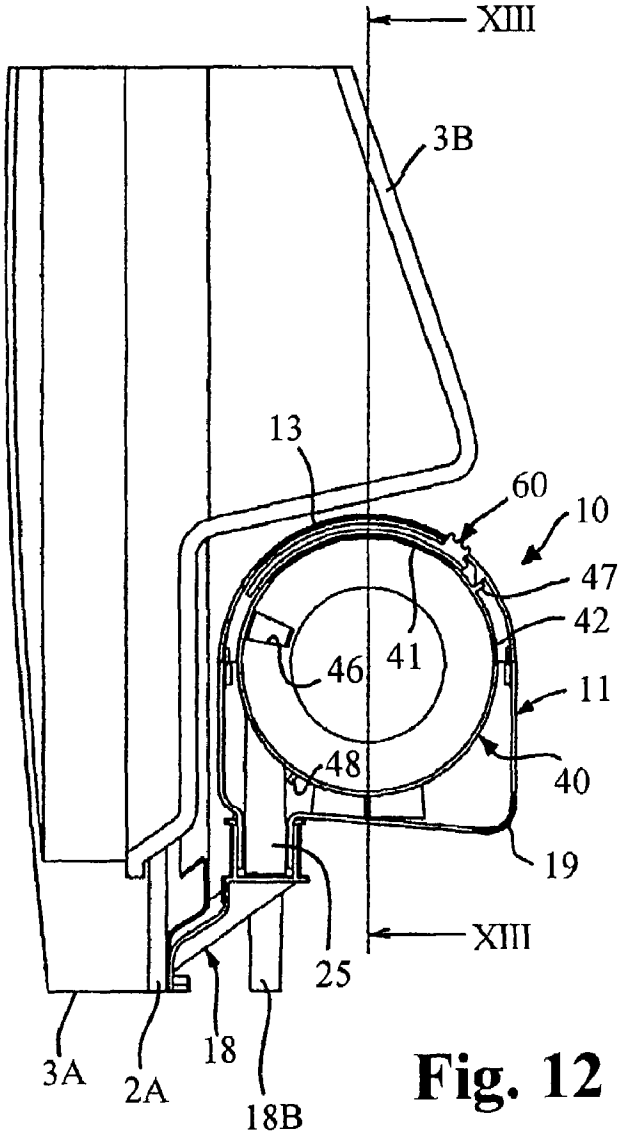
FIG. 12 is a schematic section according to the line XII-XII of FIG. 11 (or according to the line XII-XII of FIG. 13)
Figure 16:
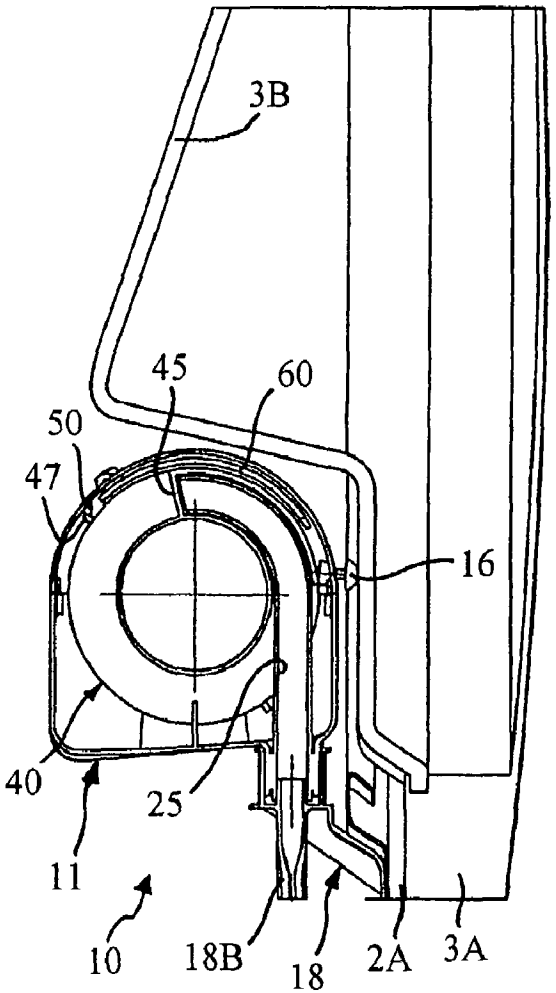
FIGS. 14, 15 and 16 are schematic sections respectively according to the lines XIV-XIV, XV-XV and XVI-XVI of FIG. 13.
Figure 14:
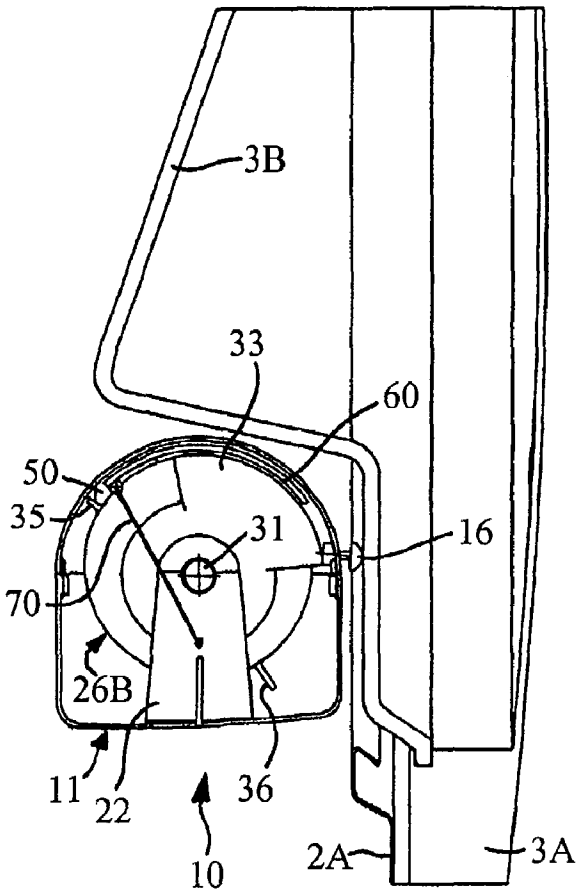
Figure 18:
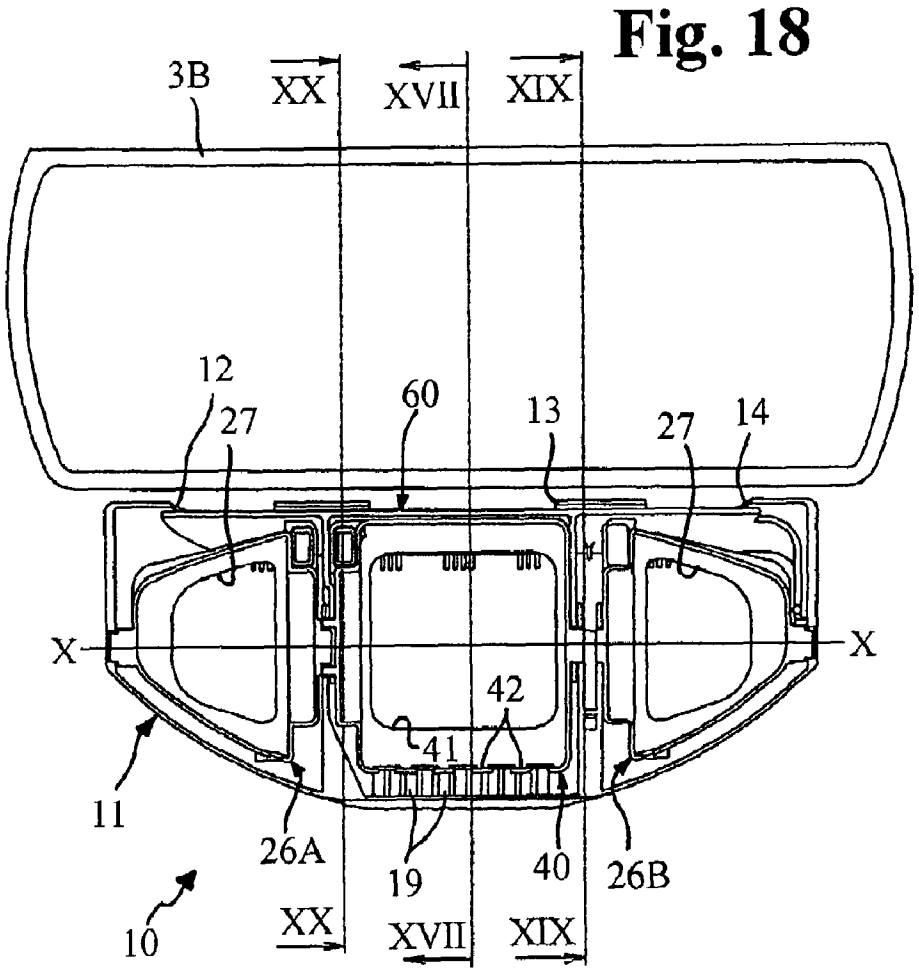
FIG. 18 is a schematic section according to the line XVIII-XVIII of FIG. 17.
Figure 17:
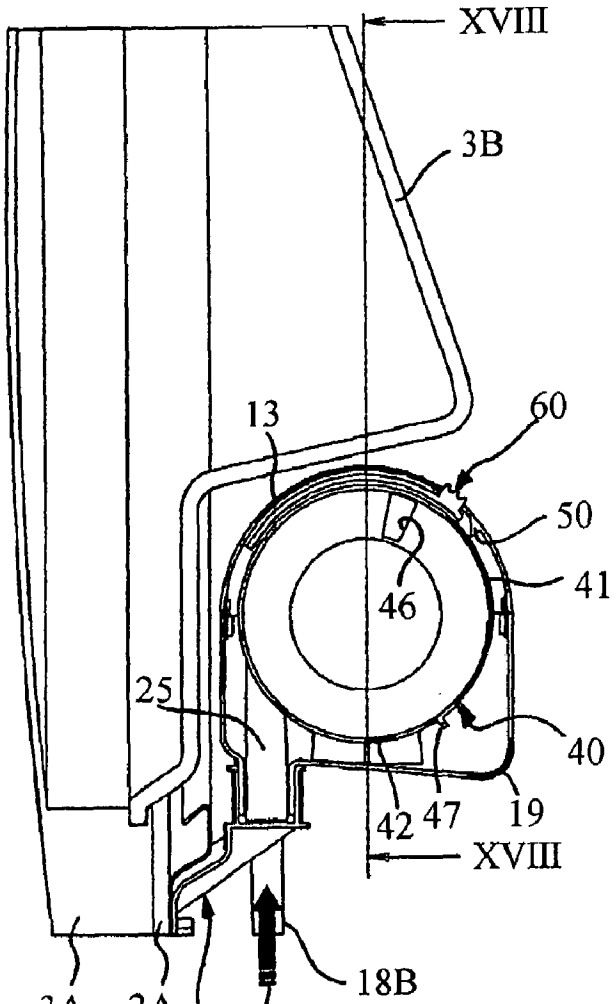
FIG. 17 is a schematic section similar to that of FIG. 12 (and according to the line XVII-XVII of FIG. 18), but in a third operative condition of the illustrated part.
Figure 19:
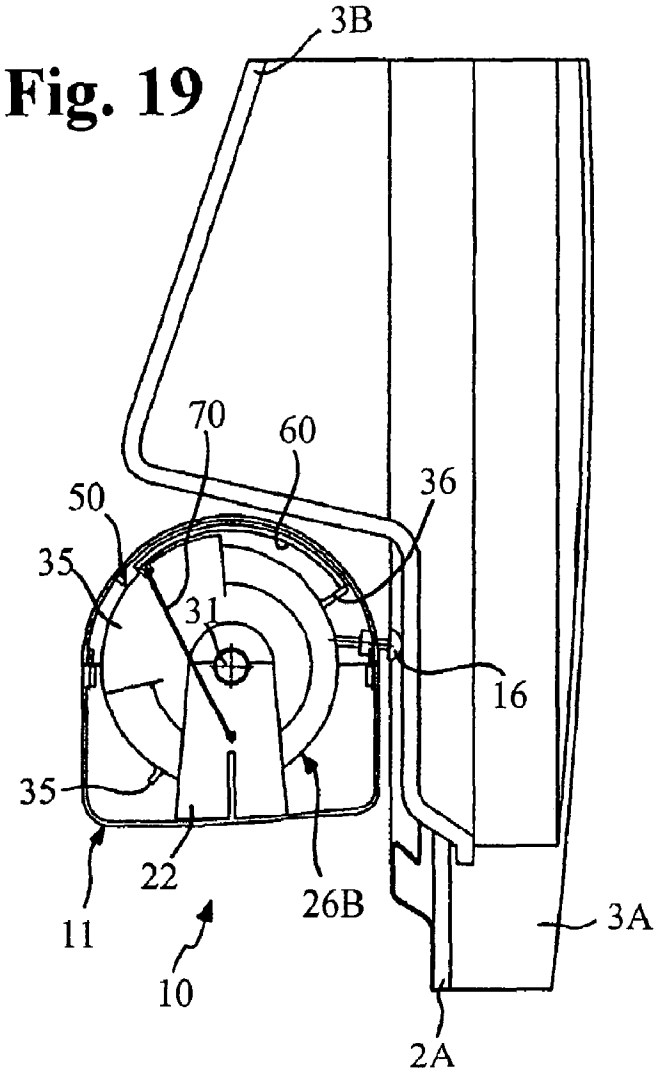

From the lower surface of the door 60 two brackets originate, designated 61 and 62, each provided with a through hole and destined to co-operate with the projections 31 and 44 of the containers 26A, 26B and 40, as well as with the brackets 20, 21, 22 which rise from the bottom of the half-shell 11B. In the upper surface of the door 60 a grip point 63 is provided; in correspondence with a longitudinal end of the door 60 a projection is also provided, defining a cam profile, designated 64, destined to co-operate with the rod 16, as shown also in FIG. 8. Between the door 60 and the bracket 22 a traction spring is anchored, serving the function of maintaining the door in the closed or opened position, as shall become readily apparent hereafter. The aforementioned spring is schematically shown in FIGS. 7, 14 and 19, where it is designated by the number 70.

For purposes of assembling the dispenser 10, the lateral pivots 43 and 44 of the container 10 are inserted into the holes of the brackets 61, 62 of the door 60; the part of said pivots 43, 44 projecting from the brackets of the cover 60 is then inserted into the holes of the brackets 20 and 21; in this step, the channel 45 of the container 40 is inserted on the conduit 25. Subsequently, the pivot 31 of the container 26A is inserted into the blind seat formed in the pivot 44 of the container 40, whilst the pivot 32 of the container 26A is placed in the respective recess 23 defined on the upper edge of the half-shell 11B; in this step, the channel 33 of the container 26A is inserted on the conduit 24. On the other side, the pivot 31 of the container 26B is inserted into the through hole of the bracket 22, whilst the pivot 32 of the container 26B is placed in the respective recess 23 defined on the upper edge of the half-shell 11B; in this step, the channel 33 of the container 26B is inserted on the respective conduit similar to those designated as 24, 25 (as stated, the conduit related to the channel 33 of the container 26B is not shown for the sake of greater clarity). The spring 70 is anchored between the door and the bracket 22. At this point, to the half-shell 11B is coupled the half-shell 11A, provided with the respective rod 16. The distributor 18 is fastened to the inner surface of the front wall of the cabinet 2, 2A and to the union fittings 18A, 18B (and to the one related to the conduit that is not shown herein) are connected the respective water supply pipes. Into the distributor 18 the respective fitting 17 of the body 11 is then coupled.

Figure 5:
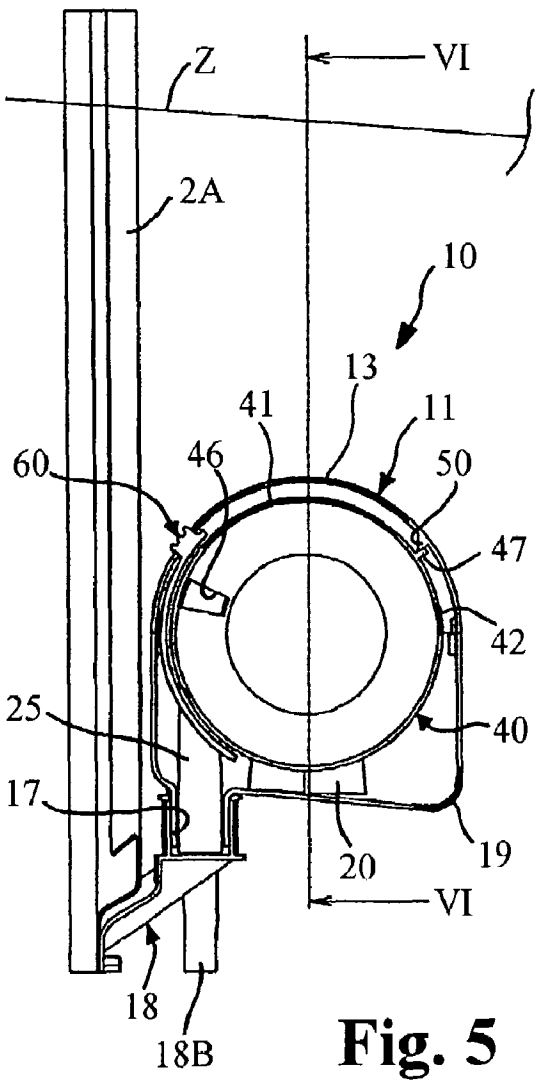
FIG. 5 is a schematic section according to the line V-V of FIG. 3 (or according to the line V-V of FIG. 6)

As a result of the aforesaid mounting, the individual containers 26A, 26B and 40 are pivotally supported within the body 11 of the dispenser, i.e. capable of moving angularly according to an axis X (see FIG. 6) which is coaxial to the pivots 31, 32, 43 and 44; the axis X extends substantially perpendicularly or transversely to the axes Y of the loading openings 27, 41 of the containers 26A, 26B and 40 and/or to the axis of rotation Z of the of the drum of the machine, as partially shown in FIG. 5 (in the exemplified case, the drum rotates according to a slightly inclined axis Z). Similarly considerations obviously hold true for the door 60.

The operation of the dispenser 10 is as follows.

For the purposes of the laundry to be washed in the drum of the machine 1, the door 3 is opened, to assume the position shown in FIG. 2. This condition is shown in FIGS. 5-9. In this condition, after loading the laundry in the machine, the user manually opens the door 60, acting on the respective grip 63 and overcoming the action of the spring 70; upon reaching the position shown in FIG. 7, the spring 70 maintains the door 60 in the open position. After this operation, the various containers are in the position shown in FIG. 6, in which the opening 27 of the container 26A, the opening 41 of the container 40 and the opening 27 of the container 26B are respectively aligned to the openings 12, 13 and 14 of the body 11.

The desired dose of soap, necessary for the washing operation, is then inserted into the container 40; into the container 26B the desired dose of softener may be inserted; if provided, alternatively to the loading of the container 40, the desired dose of bleach is inserted into the container 26A. Note that, given the position of the outflow slits 32, 42, substantially orthogonal to the loading openings 27, 41 of the respective containers 26A, 26B and 40, the washing agents inserted do not flow out of the containers.

Figure 8:
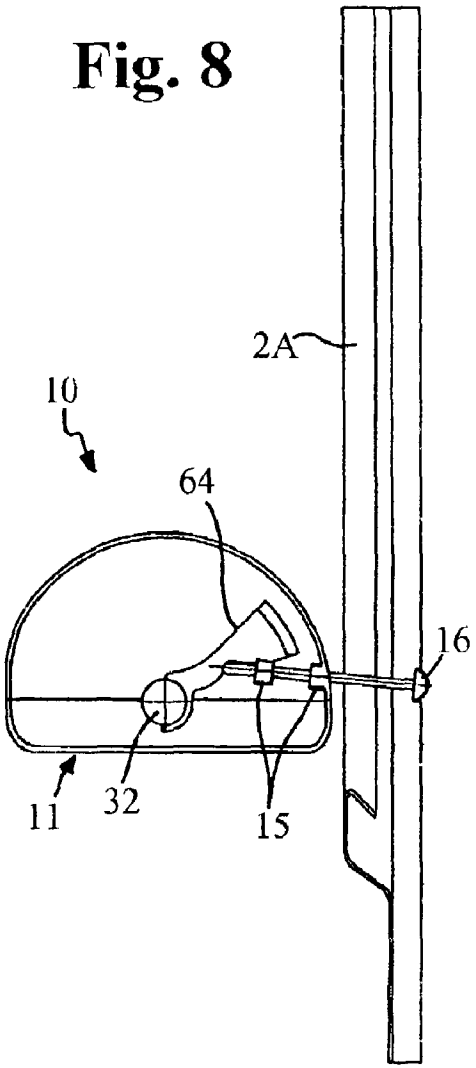

In this condition, the rod 16 projects prevalently from the body 11, its end inside the body bearing on a first part of the cam profile 64, as shown in FIG. 8. In this step, the end of the conduits 24, 25 substantially abuts the bottom of the respective channels 33, 45 of the containers 26A (and 26B) and 40; this situation is shown in FIG. 9, relative to the container 40. The user can then manually shut the door 3 of the machine, in manners known in themselves, ad start the wash cycle previously selected by means of the selector 5.

Figure 15:
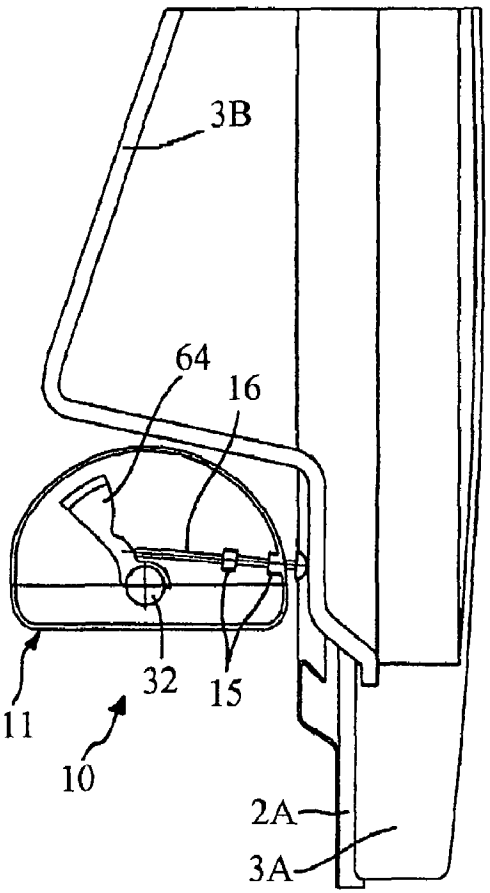

During the closing of the door 3, the part 3B comes in contact with the head of the rod 16, thrusting the rod towards the interior of the body 11; the opposite end of the rod 16 is thus pressed on the cam profile 64, causing its motion, until it reaches the position shown in FIG. 15; thereby a similar movement of the door 60, whereto the cam profile 64 is associated, is clearly obtained. The operative position of the dispenser 10 following the closing of the door 3 of the machine and of the door 60 is shown in FIGS. 11-16. Note that in this step the movement imparted to the door 60 determines the angular movement of the spring 70, which moves from the position of FIG. 14; in this condition, the spring 70 maintains the door 60 in the closed position.

At a certain point of the wash cycle being carried out, the control system of the machine 1 commands the step of withdrawing the washing agent of interest from the respective container, which here is presumed to be the container 26A. Essentially, in this step, the control system commands the opening of a solenoid valve operative along the pipe that carries water to the union fitting 18A of the distributor 18. The flow of water, indicated by the arrow IN of FIG. 20, so penetrates the union fitting 18A, to then to climb along the conduit 24; at the exit from the conduit 24, the flow impacts first the end wall of the respective channel 33 and then tends to fill said channel, pressure of the water supply line overcoming friction on the pivots 31, 32.

Figure 20:
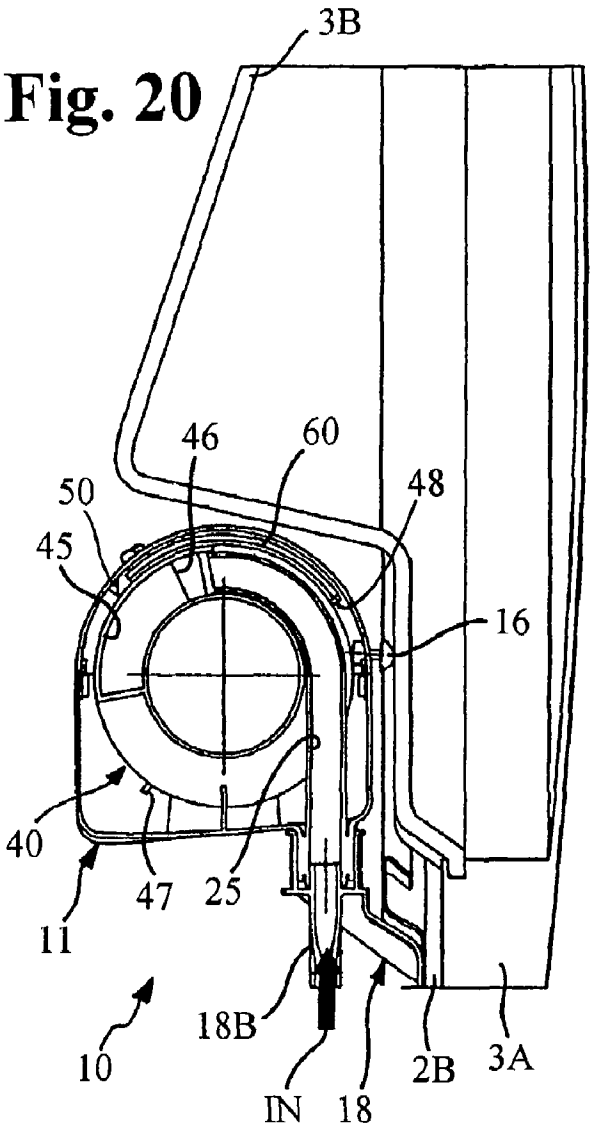
FIGS. 19 and 20 are schematic sections respectively according to the lines XIX-XIX and XX-XX of FIG. 18.

The pressure of the water flowing in so determines the angular movement of the container 26A, until assuming the position shown in FIG. 20. In this condition, only the terminal segment of the conduit 24 is still inserted in the channel 33. As shown in FIG. 20, because of the angular motion of the container 26A, the port 34 of the container 26A is now free, i.e. no longer covered by the conduit 24; the water flowing in therefrom can thus now flow directly into the container 26A. The operation is similar in the case of the containers 26B and 40.

As a result of the rotation of the container obtained by means of the water pressure, as described above, the slits 28 or 43 of the container 26A, 26B or 40 are now oriented towards the bottom of the body 11. The water flowing in from the port 34 or 46 can mix with the washing agent present in the respective container and then flow out with the agent itself through the slits 28, 43 on the bottom of the body 11, which is slightly inclined downwards; the water-washing agent mixture can thus flow out of the body 11 through the slits 19, in the area of the gasket between the front wall of the cabinet 2 and the washing tub, to be conveyed through said gasket directly into the mouth of the drum of the machine 1.

Note that the flow of water carried to the container 26A, 26B or 40 continues for a certain period of time, certainly longer than that necessary to remove the washing agent; the container and the interior of the body 11 are thereby thoroughly washed. The water needed to carry out one or more successive steps of the cycle which do not provide for the use of detergent (for example, the first rinsing step) can equally be made to transit through the dispenser 10, as described above.

In a particularly advantageous embodiment, the fitting 17 can be manually separated from the distributor 18, i.e. extractable therefrom, to enable the user completely to remove the body 11 of the dispenser from the machine 1, in order to conduct a thorough periodic cleaning, for instance in a sink.

At the end of the wash cycle, the laundry can be extracted from the machine, after opening the door 3; in this situation, the door 60 of the dispenser 10 is still kept shut by the spring 70, in spite of the fact that the rod 60 is no longer pressed against the cam profile 64; the container or containers 26A, 26B and 40 are still in the position shown in FIGS. 17-20.

For purposes of loading the washing agent or agents to carry out a new operating cycle of the machine 1, the user manually opens the door 60, acting on the respective grip 63. In this way, the door 60 is moved angularly, clockwise, until the grip itself abuts against the edge of the upper opening 13 of the body 11, as shown for example in FIG. 2 or 5. During this operation, the edge of the door 60 opposite the one where the grip 63 is defined comes to abut against the projections 36 and 48, respectively, of the containers 26A, 26B and of the container 40 (see for example FIG. 7, with reference to the projection 48 of the container 40). The containers are thus set in rotation by the movement imparted to the door 60, until their projections 35, 47 come to abut on respective abutments defined in the inner part of the half-shell 11B; some of said projections are visible in FIGS. 5, 7 and 9, where they are designated by the reference number 50. On the other side, the spring 70 returns to the position shown in FIG. 7, in which it maintains the door 60 in the open position. Thus, the position is again that of FIG. 6, in which the opening 27 of the container 26A, the opening 41 of the container 40 and the opening 27 of the container 26B are aligned respectively to the openings 12, 13 and 14 of the body 11.

From the above description, the characteristics and the advantages of the present invention are readily apparent.

The described dispenser is convenient and simple to operate for the user, who simply carries out the operations of loading the washing agents of interest, since the compartment or compartments containing the washing agent are "automatically" moved from the respective loading position to the dispensing position, directly by the flow of the water used to wash the laundry. Practical tests conducted have also allowed to verify that the dispenser described herein has a precise and reliable operation.

The presence of the system constituted by the spring 70, which is capable of assuming two stable working positions (FIGS. 7 and 14) assures that the door is maintained in the operative position in the various phases of employment of the dispenser 10.

A substantial advantage of the invention is that, by virtue of the type of operation and movement of the containers 26A, 26B and 40, there is no need to provide the typical siphons of known drawer dispensers, which are always a critical elements.

An additional advantage of the invention is that the water—washing agent mixture can come directly and rapidly in contact with the laundry, guided by the aforesaid gasket which extends between the opening of the cabinet and the mouth of the drum: the risk is thereby avoided of an accumulation in the lower space between tub and drum, ending in the drain conduit, as occurs instead in traditional laundry washing machines. In other words, according to the invention, the distributor of washing agents 10 has a functionality that is very similar to the one obtained with the use of containers, or so-called "balls", to be inserted in the drum together with the laundry.

Nearly all the components of the dispenser can be obtained by simple moulding operations of thermoplastic material, with evident advantages in terms of cost reduction.

It is clear that numerous variants are possible to the laundry washing machine and to the washing agent dispenser described by way of example, without thereby departing from the scope of novelty of the inventive idea, and it is also clear that in the practical embodiment of the invention, the shapes, dimensions, materials and components used may differ from those indicated above by way of example, and replaced by technically equivalent elements.

For example, although the provision of the rod 16 and of the respective cam profile 64 of the door 60 is advantageous, it must be considered optional, since the door 60 could be closed manually, with an opposite manoeuvre to the opening operation described above.

The sliding coupling between the channels 33, 45 of the containers 26A, 26B, 40 with the respective conduits 24, 25 could be inverse relative to the one exemplified herein, i.e. with the channels inserted in the conduits.

In alternative embodiments, the dispenser according to the invention could be positioned in different points of the machine from the one described above, for example in a housing defined in the upper part of the cabinet 2.

The invention claimed is:

1. A laundry washing machine having a washing agent dispenser which comprises at least a movable body defining a space or compartment for containing a dose of a respective washing agent, said space having a loading mouth open according to a respective first axis, a housing for said movable body and means for carrying into said space a flow of liquid able to withdraw said washing agent, said movable body being mounted in said housing in such a way as to be able to assume a first position, for the manual admission of said washing agent into said space through said loading mouth, and a second position, for the withdrawal of said washing agent from said space by means of said flow of liquid, wherein said movable body is pivotally supported in said housing to move angularly from said first to said second position and vice versa around a second axis that is substantially perpendicular or anyway transverse relative to said first axis of said loading mouth, and wherein said housing comprises a casing in which said movable body is substantially enclosed, said casing having a respective upper opening, in said first position said loading mouth of said movable body being substantially aligned to said upper opening, a lid is movably mounted relative to said casing, which lid is capable of assuming an inoperative position, in which said upper opening is open, and an operative position, in which said upper opening is obstructed, and the washing agent dispenser further comprises transmission means, to transfer to said movable body a movement imparted to said lid, in order to move said movable body from said second position to said first position.

2. A laundry washing machine as claimed in claim 1, wherein said second axis is substantially perpendicular or anyway transverse relative to an axis around which a drum of the machine is capable of rotating.

3. A laundry washing machine as claimed in claim 1, wherein said second axis is substantially horizontal.

4. A laundry washing machine as claimed in claim 1, wherein said casing is mounted in proximity to the lower edge of an opening present in a front wall of a cabinet of the machine, in such a way as to project towards the interior of said machine.

5. A laundry washing machine as claimed in claim 1, wherein said casing has one or more slits for the outflow of said washing agent together with the liquid of said flow.

6. A laundry washing machine as claimed in claim 1, further comprising stop means for arresting the angular movement of said movable body from said second to said first position.

7. A laundry washing machine as claimed in claim 1, further comprising a bistable system operative to maintain said lid in the respective inoperative and operative positions.

8. A laundry washing machine as claimed in claim 1, wherein said movable body lacks siphon means.

9. A laundry washing machine as claimed in claim 1, wherein said dispenser comprises two or more of said movable bodies.

10. A laundry washing machine, having a washing agent dispenser which comprises at least a movable body defining a space or compartment for containing a dose of a respective washing agent, said space having a loading mouth open according to a respective first axis, a housing for said movable body and means for carrying into said space a flow of liquid able to withdraw said washing agent, said movable body being mounted in said housing in such a way as to be able to assume a first position, for the manual admission of said washing agent into said space through said loading mouth, and a second position, for the withdrawal of said washing agent from said space by means of said flow of liquid, wherein said movable body is pivotally supported in said housing to move angularly from said first to said second position and vice versa around a second axis that is substantially perpendicular or anyway transverse relative to said first axis of said loading mouth, the machine further comprising actuating means operative for determining the movement of said body from said first to said second position by means of said flow of liquid, wherein said actuating means comprise at least a conduit for carrying said flow of liquid and a channel of said movable body operatively coupled to said conduit.

11. A laundry washing machine as claimed in claim 10, wherein said channel of said movable body is operatively coupled in sliding fashion to said conduit.

12. A laundry washing machine as claimed in claim 11, wherein said conduit is operatively inserted in said channel, or vice versa.

13. A laundry washing machine as claimed in claim 11, wherein each of said conduit and channel has at least an arched segment.

14. A laundry washing machine as claimed in claim 11, wherein said channel comprises an inlet and said actuating means comprise an outlet port of said channel proximate to said inlet, said outlet port being capable of placing in communication the channel with said space.

15. A laundry washing machine as claimed in claim 14, wherein, in said first position of said movable body, said outlet port is substantially obstructed by means of a surface of said conduit and wherein, in said second position of said movable body, said outlet port is substantially freed from said surface.

16. A laundry washing machine as claimed in claim 10, wherein said housing comprises a casing in which said movable body is substantially enclosed, said casing having a respective upper opening, in said first position, said loading mouth of said movable body being substantially aligned to said upper opening.

17. A laundry washing machine having a washing agent dispenser which comprises at least a movable body defining a space or compartment for containing a dose of a respective washing agent, said space having a loading mouth open according to a respective first axis, a housing for said movable body and means for carrying into said space a flow of liquid able to withdraw said washing agent, said movable body being mounted in said housing in such a way as to be able to assume a first position, for the manual admission of said washing agent into said space through said loading mouth, and a second position, for the withdrawal of said washing agent from said space by means of said flow of liquid, wherein said movable body is pivotally supported in said housing to move angularly from said first to said second position and vice versa around a second axis that is substantially perpendicular or anyway transverse relative to said first axis of said loading mouth, wherein said housing comprises a casing in which said movable body is substantially enclosed, said casing having a respective upper opening, in said first position, said loading mouth of said movable body being substantially aligned to said upper opening, and a lid is movably mounted between said movable body and said casing, which lid is capable of assuming an inoperative position, in which said upper opening is open, and an operative position, in which said upper opening is obstructed.

18. A laundry washing machine as claimed in claim 17, further comprising transmission means to transfer to said movable body a movement imparted manually to said lid, in order to move said movable body from said second position to said first position.

19. A laundry washing machine as claimed in claim 17, having a door, wherein actuating means are provided to transfer to said lid a movement imparted manually to said door, to move said lid from said inoperative position to said operative position.

* * * * *